US007926773B1

(12) United States Patent
Duke

(10) Patent No.: US 7,926,773 B1
(45) Date of Patent: Apr. 19, 2011

(54) CLAMPS FOR MOTOR VEHICLE FRAME STRAIGHTENER

(76) Inventor: Todd Duke, Gilbert, AZ (US)

( * ) Notice: Subject to any disclaimer, the term of this patent is extended or adjusted under 35 U.S.C. 154(b) by 816 days.

(21) Appl. No.: 11/776,210

(22) Filed: Jul. 11, 2007

(51) Int. Cl.
*A47B 96/00* (2006.01)
*A47G 29/00* (2006.01)

(52) U.S. Cl. ..... 248/226.11; 248/228.2

(58) Field of Classification Search ..... 248/228.2, 248/231.31, 188.2, 188.4, 214, 228.1, 228.6, 248/228.5, 228.3, 226.11; 411/44, 84; 72/422, 72/705

See application file for complete search history.

(56) References Cited

U.S. PATENT DOCUMENTS

| | | | | | |
|---|---|---|---|---|---|
| 3,053,494 | A * | 9/1962 | Stoll | 248/228.3 |
| 4,141,524 | A * | 2/1979 | Corvese, Jr. | 248/70 |
| 4,300,754 | A * | 11/1981 | Lawrence | 269/8 |
| 4,598,208 | A * | 7/1986 | Brunelli et al. | 250/515.1 |
| 4,746,780 | A * | 5/1988 | Resh | 200/294 |
| H906 | H * | 4/1991 | Baggett et al. | 403/409.1 |
| 5,044,191 | A * | 9/1991 | Combs | 72/422 |
| 5,335,533 | A * | 8/1994 | Rehus | 72/422 |
| 6,354,399 | B1 * | 3/2002 | Austin | 182/36 |

* cited by examiner

*Primary Examiner* — Amy J Sterling
(74) *Attorney, Agent, or Firm* — Michael R. Schramm

(57) ABSTRACT

An apparatus designed to provide quick connect capability between a frame straightener and a vehicle chassis comprising a plurality of varying clamp members designed to secure to the various apertures within the chassis frame and tubular inter frame-rail cross members according to the restrictions of varying attachment points thereof and thereby enabling rapid installation and removal of multiple anchors and torsion tethers thereto.

13 Claims, 9 Drawing Sheets

CLAMPS FOR MOTOR VEHICLE FRAME STRAIGHTENER

BACKGROUND OF THE INVENTION

1. Field of the Invention

The present invention relates generally to motor vehicle frame straighteners and, more specifically, to motor vehicle chassis fasteners designed to provide quick connect capability between the frame straightener and the vehicle chassis.

The fasteners are designed to use a number of apertures within the chassis frame and tubular inter frame-rail cross members that will enable a quick connect of anchors and torsion tethers.

2. Description of the Prior Art

There are clamps used in conjunction with frame straighteners for attachment to a motor vehicle chassis.

While these clamps may be suitable for the purposes for which they were designed, they would not be as suitable for the purposes of the present invention, as hereinafter described.

Therefore, it is felt that a need exists for quick connect clamps to shorten the set up time for a pull.

SUMMARY OF THE PRESENT INVENTION

A primary object of the present invention is to provide a clamp set to be used in conjunction with a frame straightener.

Another object of the present invention is to provide a clamp set that provides means for quickly fastening to a vehicle chassis.

Yet another object of the present invention is to provide a clamp set having a cylindrical component having a top side and a bottom side with a threaded bore passing therebetween.

Still yet another object of the present invention is to provide a clamp component comprising flat stock with a transverse bore on opposing ends.

Another object of the present invention is to provide a clamp component having a top side with a track and a planar bottom side. Passing longitudinally through the body is a bore whereby a threaded member extends through engaging a wedge member that when tightened will force the displaceable members apart.

Yet another object of the present invention is to provide a set of clamps designed to engage structural components of a motor vehicle frame.

Still yet another object of the present invention is to provide a clamp set that is easy to manufacture.

Additional objects of the present invention will appear as the description proceeds.

The present invention overcomes the shortcomings of the prior art by providing to motor vehicle chassis clamps designed to provide a quick connect capability between a frame straightener and a vehicle chassis. The clamps are designed to use a number of apertures within the chassis frame and tubular inter frame-rail cross members that will enable a quick connect of anchors and torsion tethers.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
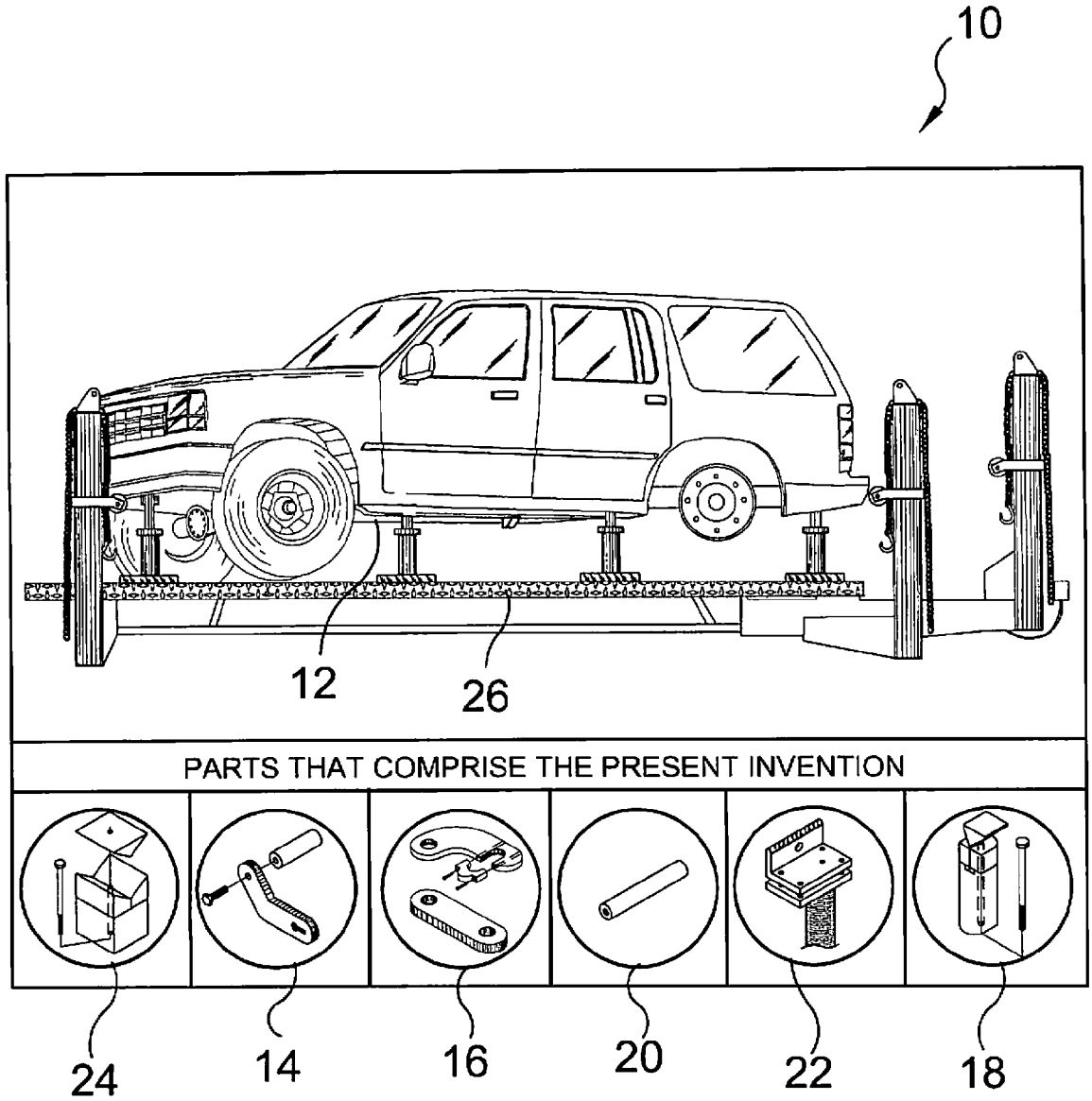
FIG. 1 is an illustrative view of the application of the present invention.

Turning now descriptively to the drawings, in which similar reference characters denote similar elements throughout the several views, the figures illustrate the Apparatus for Providing Quick-Connect Clamps for Straightening the Frame of a Motor Vehicle of the present invention. With regard to the reference numerals used, the following numbering is used throughout the various drawing figures.

10 Apparatus for Providing Quick-Connect Clamps for Straightening the Frame of a Motor Vehicle of the present invention
12 vehicle chassis frame
14 pivotal torsion tensioner receiver
16 flat stock clamp
18 expansion wedge clamp
20 threaded bore cylinder clamp
22 flanged sandwich clamp
24 expansion wedge block clamp
26 frame straightener
28 dogleg shaped plate of 14
30 cylindrical insert of 30
32 threaded bore of 30
34 circular bolt recess
36 bolt of 14
38 torsion tensioner receiver recess
40 first flat stock plate of 16
42 second flat stock plate of 14
44 bolt receiving aperture of 16
45 cap of 16
46 expansion wedge housing
48 wedge member
50 threaded expansion wedge fastener
52 displaceable member
54 smooth bore of 46
56 threaded bore of 48

58 cylinder body
60 threaded throughbore of 58
62 bottom plate of 22
64 top plate of 22
66 threaded stock of 62
68 flange member of 64
70 bolt recess of 22

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the application of the present invention 10. The present invention comprises a group of clamping elements of clamps providing means for quickly attaching a vehicle chassis 12 to a frame straightener 26. The clamps are designed to utilize the frame structure 12 for the quick connect of torsion tethers and anchors. Included among the group a pivotal torsion tensioner receiver 14, a flat stock clamp 16, an expansion wedge clamp 18, a threaded bore cylinder clamp 20, a flanged sandwich clamp 22 and a wedged block clamp 24.

Figure 2:
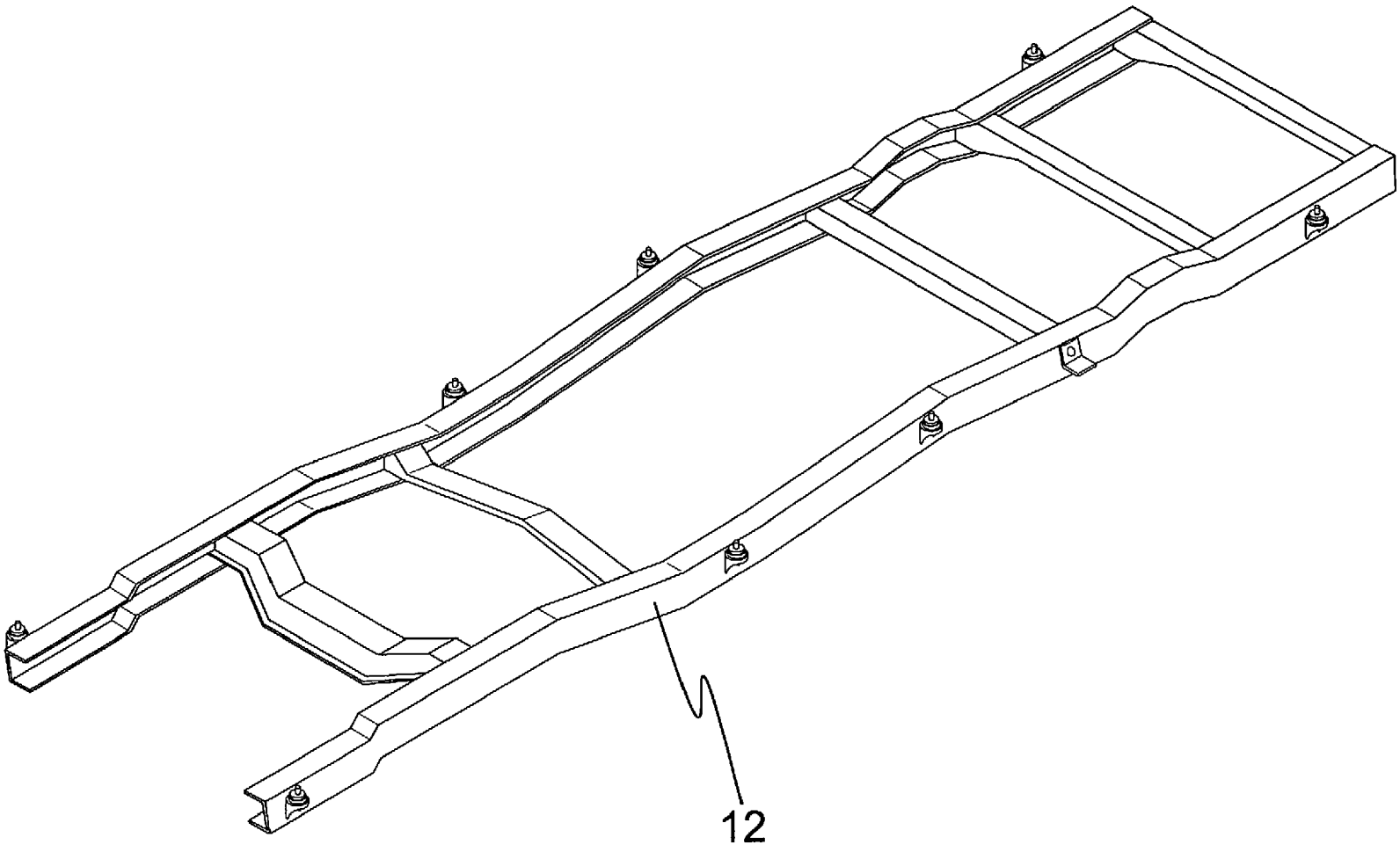
FIG. 2 is a perspective view of a vehicle chassis frame.

FIG. 2 is a perspective view of a vehicle chassis frame 12. Shown is a chassis frame 12 having a structure that is engaged by the various clamps of the tool set of the present invention 10 whereby a frame straightener having anchors and torsion tethers can be quickly attached thereto.

Figure 3:
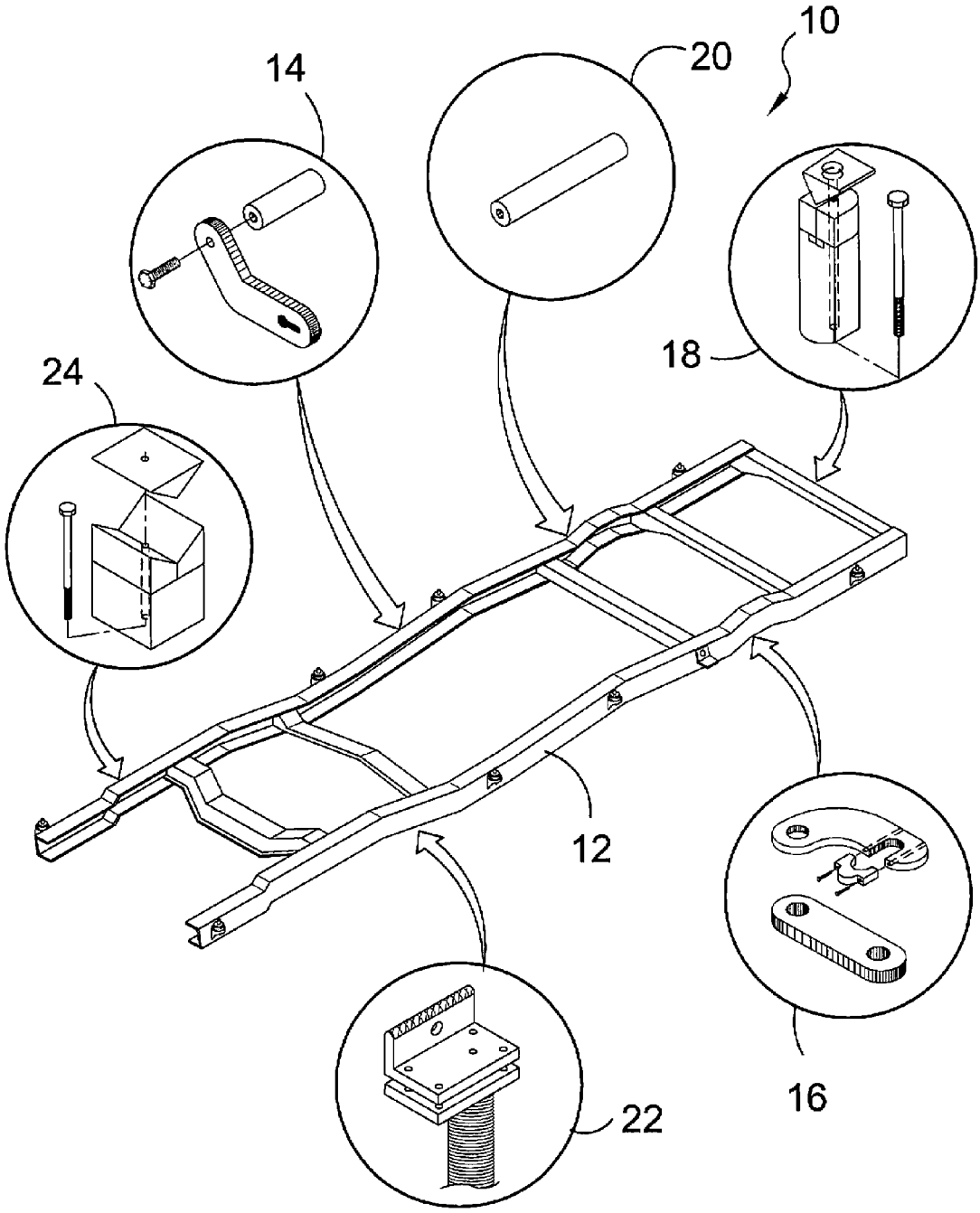
FIG. 3 is an illustrative view of the components of the present invention.

FIG. 3 is an illustrative view of the components of the present invention 10. The present invention comprises a group of clamping elements of clamps providing means for quickly attaching a vehicle chassis 12 to a frame straightener 26. The clamps are designed to utilize the frame structure 12 for the quick connect of torsion tethers and anchors. Included among the group a pivotal torsion tensioner receiver 14, a flat stock clamp 16, an expansion wedge clamp 18, a threaded bore cylinder clamp 20, a flanged sandwich clamp 22 and a wedged block clamp 24. Each of the clamps serves as quick connect means for attachment of a frame straightener's anchors and/or torsion tethers.

Figure 4:
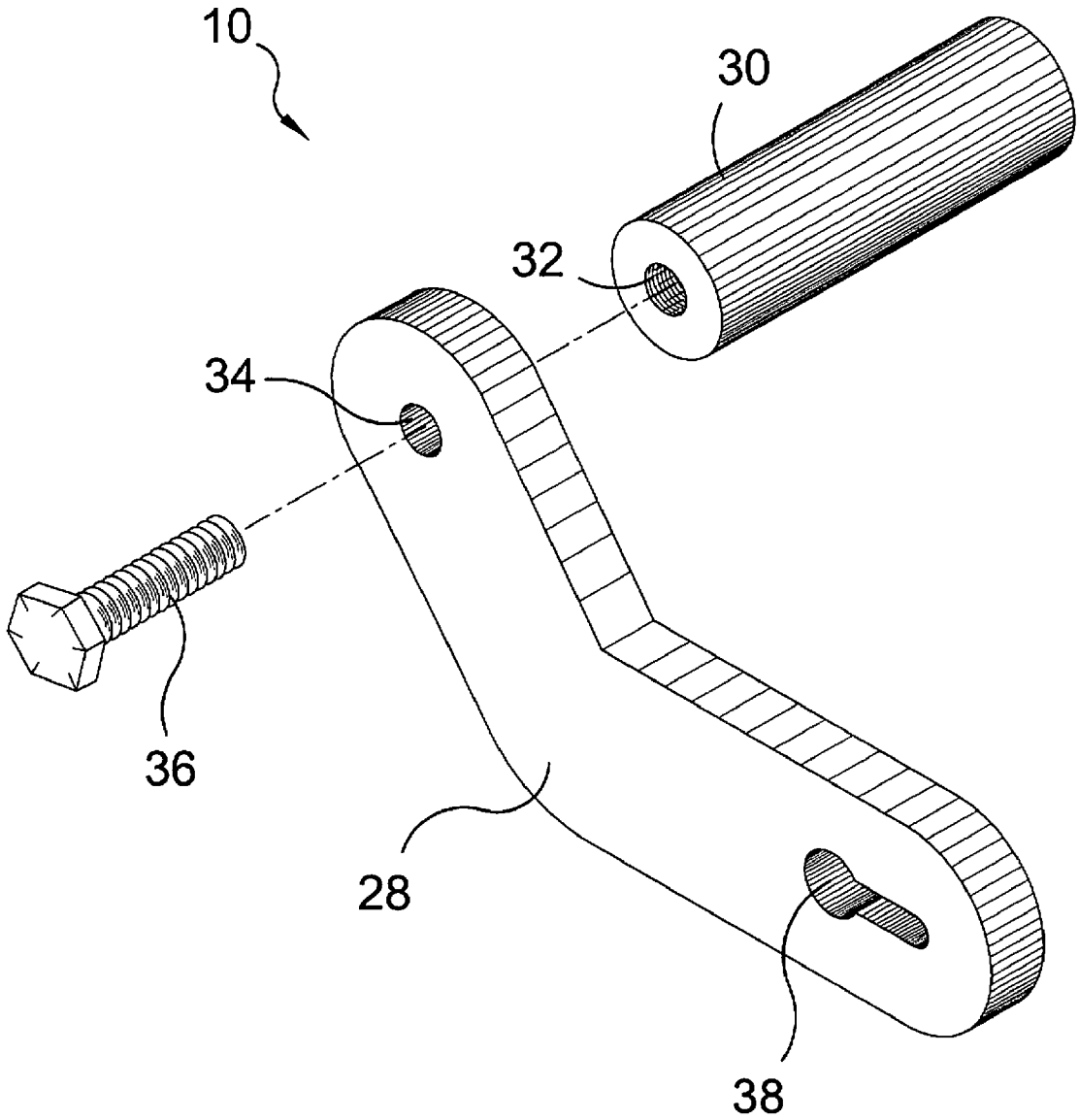
FIG. 4 is a perspective view of a clamp of the tool set of the present invention.

FIG. 4 is a perspective view of a clamp of the tool set of the present invention. Shown is pivotal torsion tension receiver 14 comprising a dogleg shaped plate 28 having a circular bolt recess 34 on one end and a keyhole shaped torsion tension receiver recess 38 on the other end. A cylindrical insert 30 with a threaded bore 32 is inserted into a frame rail aperture of similar dimension whereupon the dogleg plate 28 is threadedly mounted to the cylindrical insert 30 with a bolt 38 extending through the bolt recess 34, whether the torsion-tether receiver 14 is threadedly fastened prior to inserting the cylindrical insert 30 or after is a user preference as either method provides similar results. The receiver recess 38 is sized to receive chain which commonly serves as the tension tethers.

Figure 5:
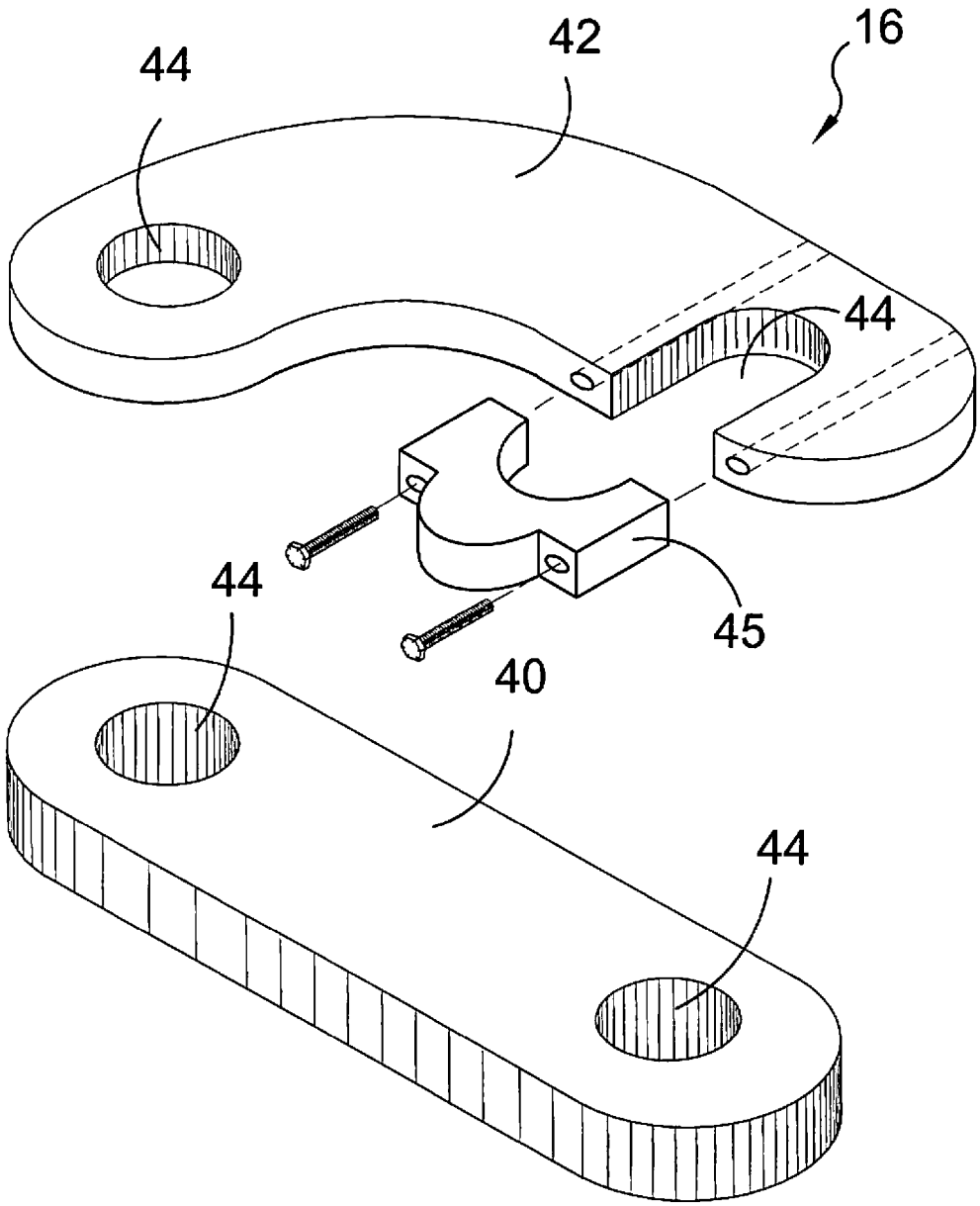
FIG. 5 is a perspective view of clamp components of the present invention.

FIG. 5 is a perspective view of clamp components of the flat stock clamp 16. Shown are clamp component comprising a first flat stock plate 40 having substantially straight sides and a second flat stock plate 42 that is substantially curved. The both stock plates have apertures 44 on opposing ends to receive bolts. Also shown is cap 45 to hold the bracket in place to prevent it from falling off and to strengthen for pull.

Figure 6:
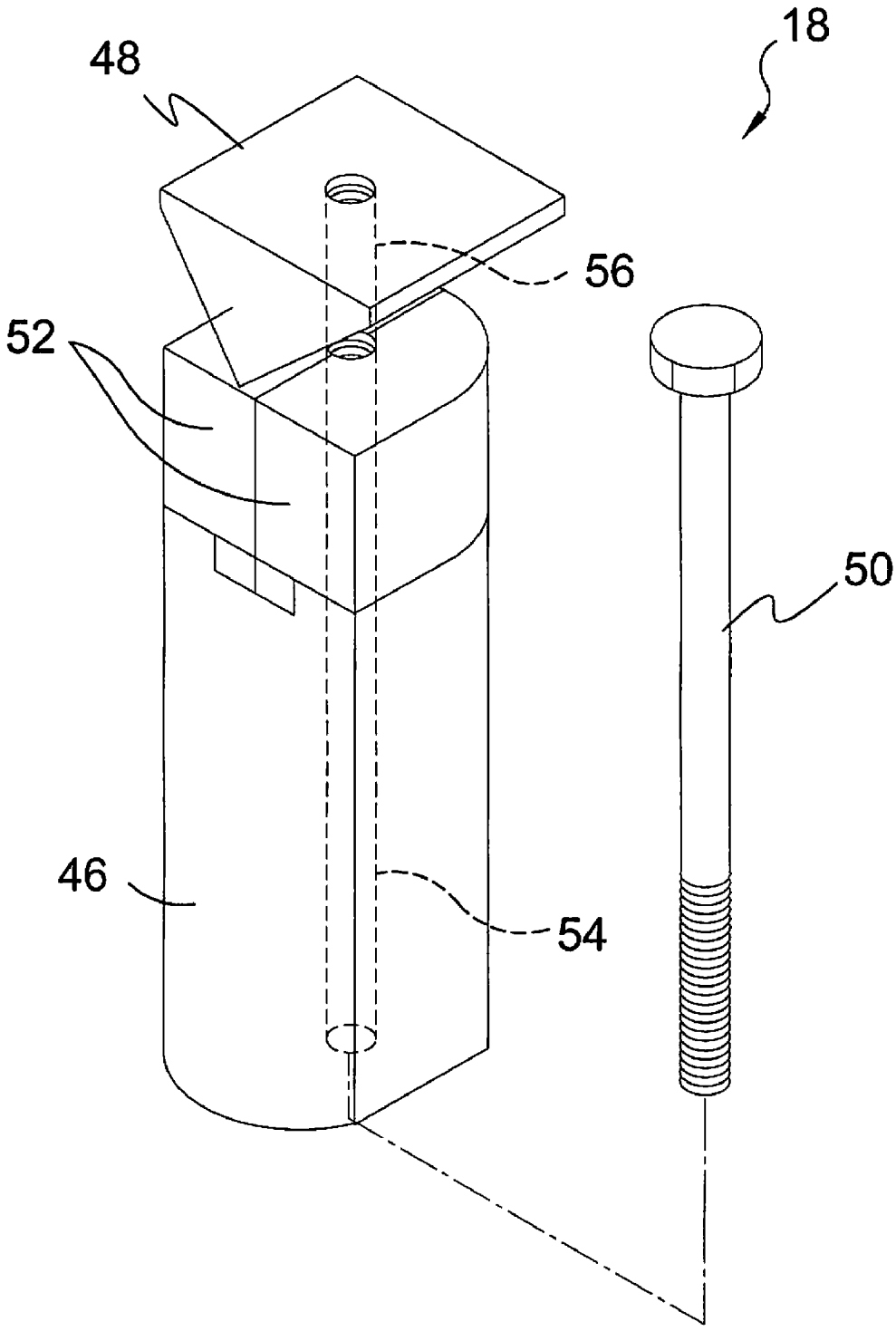
FIG. 6 is a perspective view of another clamp of the present invention.

FIG. 6 is a perspective view of the expansion wedge clamp 18 of the present invention. Shown is the clamp 18 having an elongate housing 46 with a pair of displaceable members 52 at one end, a wedge member 48 forming and inverted V-shape aligned with the seam of the displaceable members 52 and threaded fastener 50. The housing 46 has a bore 54 extending its length and the wedge-shaped member 48 include a threaded bore 56 for receiving the threaded fastener 50. In operation the threaded fastener 50 is inserted into the hosing bore 54 until engaging the threaded wedge bore 48, as the threaded fastener 50 is tightened the leading edge of the wedge 48 will force the displaceable housing members 52 apart.

Figure 7:
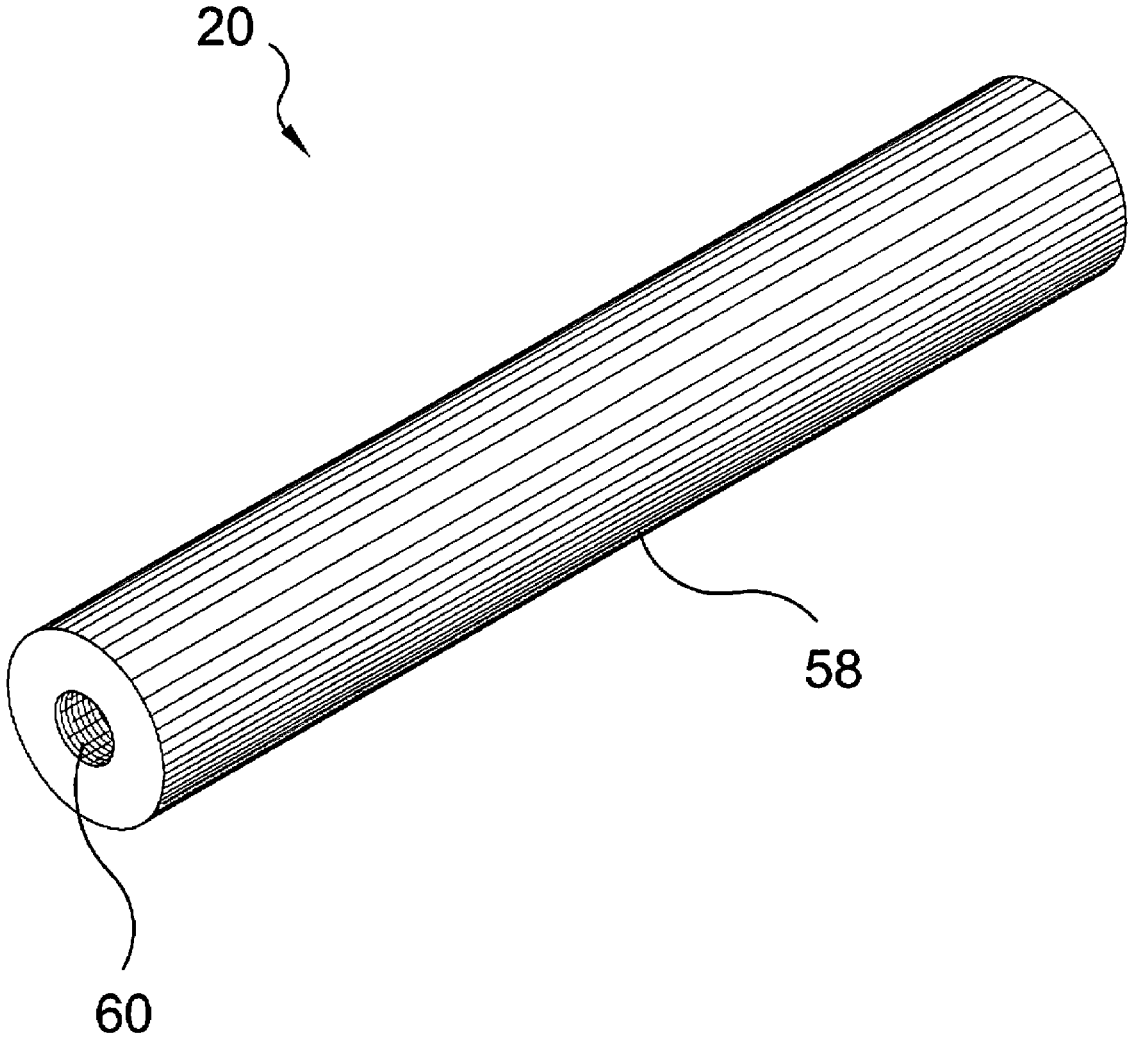
FIG. 7 is a perspective view of a clamp component of the present invention.

FIG. 7 is a perspective view of the cylinder clamp 20 of the present invention. Shown is a clamp component having a cylindrical body 58 with a threaded bore 60 extending centrally therethrough.

Figure 8:
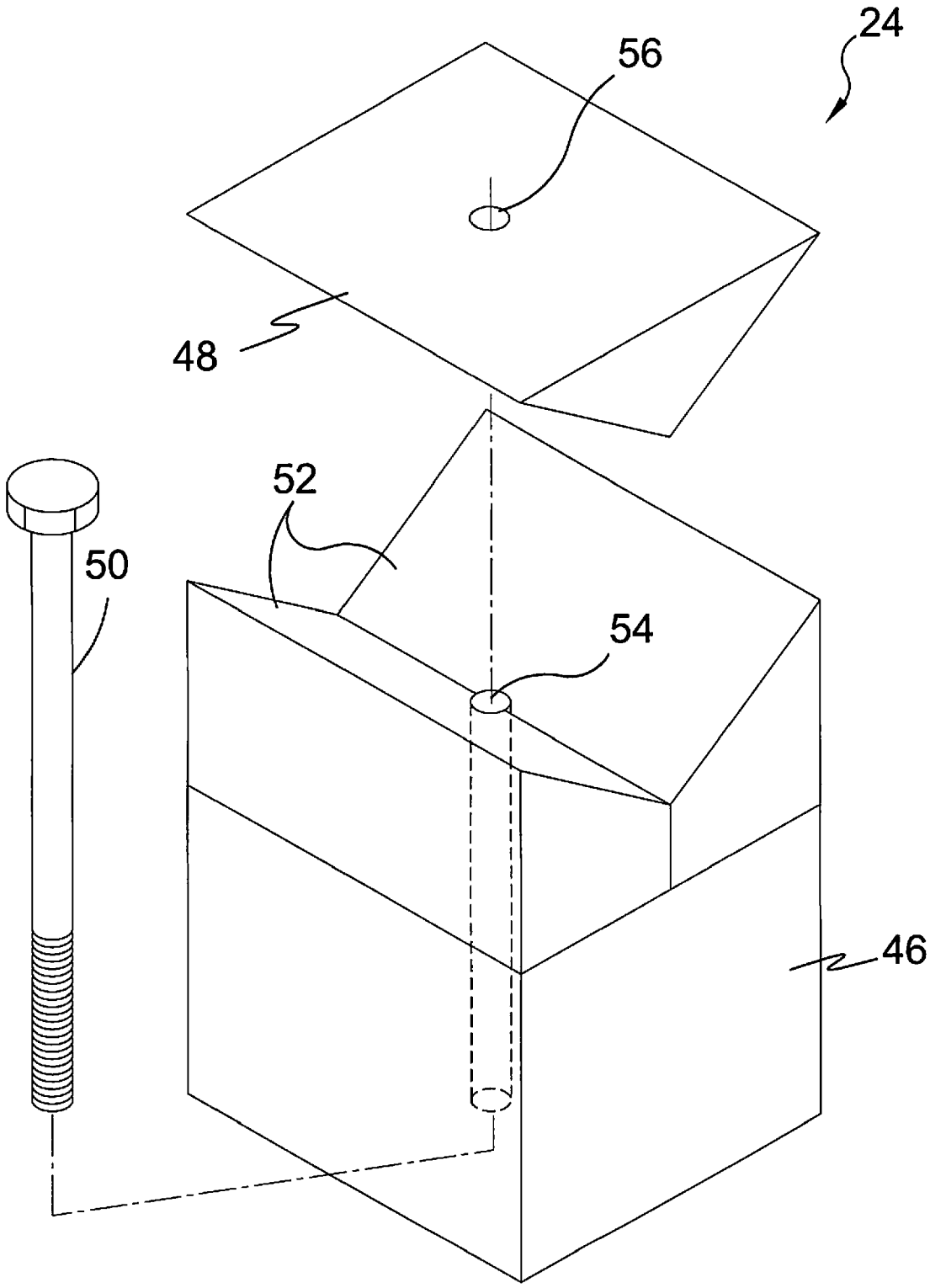
FIG. 8 is a perspective view of components of the present invention.

FIG. 8 is a perspective view of the wedge block clamp 24. this variation has a block shaped housing 46 with a pair of displaceable members 52 at one end, a wedge member 48 forming and inverted V-shape aligned with the seam of the displaceable members 52 and threaded fastener 50. The displaceable members 52 project angularly upward from the seam to the peripheral edges to conform with the shape of the wedge 48. The housing 46 has a bore 54 extending its length and the wedge-shaped member 48 include a threaded bore 56 for receiving the threaded fastener 50. In operation the threaded fastener 50 is inserted into the hosing bore 54 until engaging the threaded wedge bore 48, as the threaded fastener 50 is tightened the leading edge of the wedge 48 will force the displaceable housing members 52 apart.

Figure 9:
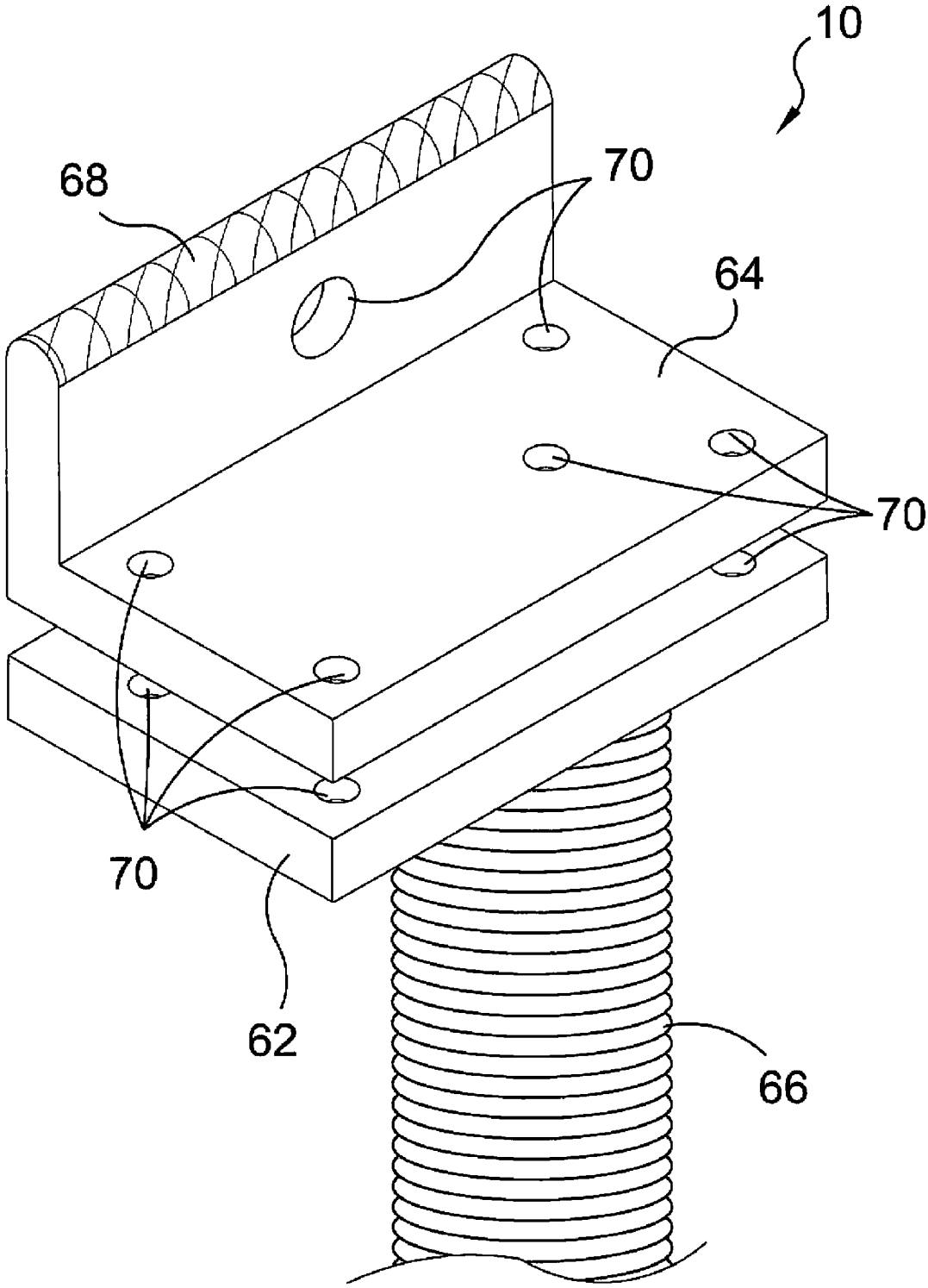
FIG. 9 is a perspective view of a clamp component of the tool set of the present invention.

FIG. 9 is a perspective view of the sandwich clamp 22 of the tool set of the present invention. Shown is a clamp having a top plate 64 and a bottom plate 62 with the top plate having a flange 68 extending therefrom. The bottom plate 62 has a length of threaded stock 66 depending from the underside of the base plate.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A vehicle frame straightening system, the system comprising:

a) a vehicle frame straightener;

b) a plurality of clamps to provide quick connect capability between the vehicle frame straightener and the vehicle frame; and c) said plurality of clamps including at least one flat stock clamp;

d) the flat stock clamp comprising:

a first flat stock plate with straight sides joining first and second arcuate ends, a first aperture through said first flat stock plate disposed adjacent said first end, a second aperture through said first flat stock plate adjacent said second end;

a second flat stock plate having curvilinear sides joining first and second arcuate ends, an aperture through said second flat stock plate adjacent said first end, a slot through said second flat stock plate adjacent said second end, said slot forming an opening in an edge of said second flat stock plate, a first threaded aperture disposed in said edge on a first side of said opening, a second threaded aperture disposed in said edge on a second opposed side of said opening; and a cap for closing said opening in said second flat stock plate, said cap having first and second bolt receiving portions joined by a central portion, each bolt receiving portion having opposed upper and lower surfaces, each bolt receiving portion having an aperture extending through said upper and lower surfaces, said central portion having a convex upper surface and an opposed concave lower surface, said convex upper surface extending outwardly beyond the upper surface of each bolt receiving portion, said concave lower surface extending inwardly beyond the lower surface of each bolt receiving portion, said cap removably secured over said opening in said second flat stock by a threaded bolt extending through the aperture in each bolt receiving portion and into a respective one of said threaded apertures in said second flat stock plate.

2. The system of claim 1, wherein said plurality of clamps further include:

a) at least one pivotal torsion tensioner receiver clamp;

b) at least one wedge clamp;

c) at least one threaded bore cylinder clamp; and d) at least one flanged sandwich clamp.

3. The system recited in claim 2, where said pivotal torsion tensioner receiver clamp comprises:

a) a dogleg shaped plate;

b) a cylindrical insert;

c) means selectively securing said dogleg shaped plate to an aperture disposed with the vehicle frame; and d) means for selectively securing a tension tether chain to said dogleg shaped plate.

4. The system recited in claim 3, wherein said means for securing said dogleg plate to the vehicle frame comprises:

a) a circular bolt recess disposed on a first end of said plate;

b) a threaded bore in said cylindrical insert; and c) a bolt sized to fit through the aperture, said bolt recess, and into said threaded bore in said cylindrical insert.

5. The system recited in claim 4, wherein said tension tether chain securing means is a tether chain receiver recess disposed on a second end of said dogleg shaped plate having a substantially keyhole shape to enable a chain pass through a wider portion thereof and lock into a narrower portion thereof.

6. The system recited in claim 2, wherein said expansion wedge clamp comprises:

a) a housing;

b) a pair of displaceable members disposed on one end of said housing;

c) a wedge member with a pointed edge aligned with a seam formed between said displaceable members;

d) a smooth throughbore extending with said housing from the center of the seam formed by said displaceable members to the opposing end thereof;

e) a threaded throughbore within said wedge aligned with said housing throughbore; and f) a threaded fastener sized to enter said housing throughbore and thread into said wedge throughbore.

7. The system recited in claim 2, wherein said threaded fastener is tightened to draw the pointed edge of said wedge into the seam between said displaceable members and forcefully separate them.

8. The system recited in claim 7, wherein said housing is elongate.

9. The system recited in claim 8, where the displaceable members have a wedge contact surface that is substantially flat.

10. The system recited in claim 6, wherein said expansion wedge clamp is a block clamp that has a substantially quadrate housing.

11. The system recited in claim 10, wherein a wedge contact surface of said displaceable members is shaped to conform substantially to said wedge to provide mating surfaces prior to penetration into said seam.

12. The system recited in claim 2, wherein said cylinder clamp is an elongate cylinder having a threaded bore extended therethrough capable of receiving threaded fastening elements therein.

13. The system recited in claim 2, wherein said flanged sandwich clamp comprises:

a) a top sandwich plate;

b) a bottom sandwich plate;

c) a flange member extending perpendicularly upward from one edge of said top plate;

d) thread stock projecting downward from a central portion of said bottom sandwich plate;

e) a plurality of bolt recesses disposed in said bottom sandwich plate;

f) a plurality of mating bolt recesses in said top sandwich plate corresponding with said bolt recesses in said bottom sandwich plate; and g) a centrally disposed recess in said flange member.

* * * * *